US007540320B1

(12) United States Patent
Semmes

(10) Patent No.: US 7,540,320 B1
(45) Date of Patent: Jun. 2, 2009

(54) HIGH EFFICIENCY CONDITIONING AIR APPARATUS

(76) Inventor: Thomas Middleton Semmes, 17276 SE. Parkers Dr., Gladstone, OR (US) 97027

( * ) Notice: Subject to any disclaimer, the term of this patent is extended or adjusted under 35 U.S.C. 154(b) by 218 days.

(21) Appl. No.: 11/351,754

(22) Filed: Feb. 10, 2006

(51) Int. Cl.
*F28F 19/01* (2006.01)

(52) U.S. Cl. ..... 165/119; 165/148; 165/151

(58) Field of Classification Search ..... None
See application file for complete search history.

(56) References Cited

U.S. PATENT DOCUMENTS 1,805,116 A * 5/1931 Trane ..... 165/68
2,063,757 A * 12/1936 Saunders ..... 165/153
2,110,024 A * 3/1938 Miller ..... 165/159
3,950,157 A * 4/1976 Matney ..... 55/490
3,994,337 A * 11/1976 Asselman et al. ..... 165/119
5,213,596 A * 5/1993 Kume et al. ..... 55/481
5,472,463 A * 12/1995 Herman et al. ..... 55/319
5,505,257 A * 4/1996 Goetz, Jr. ..... 165/183
2005/0199378 A1* 9/2005 Lamich et al. ..... 165/151

FOREIGN PATENT DOCUMENTS

JP 58019694 A * 2/1983
JP 61215121 A * 9/1986

* cited by examiner

*Primary Examiner*—Allen J Flanigan
(74) *Attorney, Agent, or Firm*—Mark S. Hubert

(57) ABSTRACT

The present invention relates to an improved air conditioning filter and cooling/heating coil that can easily be applied to new and existing air handling systems. The slant design of these components allows a more efficient heat transfer and particle entrapment than their conventional counterparts. By residing at an angle in their air handling enclosures, and by virtue of their oblique prismatic construction, more filter media can be used and more heat transfer surface area can be incorporated without offering any substantial additional impediments to the flow of air. At angles of 45 degrees air friction of the coil and filter are reduced by 40 to 55 percent.

19 Claims, 5 Drawing Sheets

HIGH EFFICIENCY CONDITIONING AIR APPARATUS

FIELD OF THE INVENTION

The present invention relates to improved apparatus for the conditioning of air. More specifically, it relates to a new design for an air filter and the coils (heat exchanger) to be used in an air handling system that maximizes the spacial constraints of the air handling containment system with filter and coil having a more geometrically efficient design. This design allows for a much higher efficiency in the air filtration capacity and the thermal conductivity of the coil.

BACKGROUND

Governmentally imposed regulations force higher efficiency standards on all commercial electro-mechanical devices in an attempt to reduce the ever increasing electrical needs of our society. Air handling systems, being one of the larger electrical energy users in commercial buildings, have recently come under stringent future regulations. Current regulations to be met by the year 2010 will force a large increase in efficiency.

Existing coils and air filters have a rectangular axial cross section and reside normally in their enclosures (air handling units). Their three dimension configuration is that of a cuboid or, stated otherwise, a right prism having only rectangular faces. Any increase in efficiency is achieved by using multiples of these units or by staggering configurations of smaller filters and coils. Overall efficiency improvements are becoming increasingly difficult.

This invention utilizes a slant design of these components that allows a more efficient heat transfer and particle entrapment than their conventional counterparts. By residing at an angle in their air handling enclosures, and by virtue of their oblique prismatic construction, more tubes can be used, more plate thermal conductive surface area can incorporated onto the coil, a larger coil face area can be realized, and more filter media can be used in the filter. When residing in the air handling unit at angles of 45 degrees, there is approximately a 41% increase in coil heat transfer area and particulate entrapment area. More importantly, the face velocity and resultant air friction of the passing air decreases significantly, thereby reducing the amount of work the prime mover has to do.

This slant design requires more linear space than single, normally situated conventional elements do, but offers considerably less restriction to air flow than do multiple normally situated conventional elements. Thus, a significant increase in efficiency can be realized with a minimum increase in spacial utilization and a significant reduction in air restriction.

Such conditioning air apparatus innovations as the present invention provides, overcome the pitfalls of the prior art and are a cost effective, simple solution that enable a considerable jump in efficiency while allowing a spatially effective air handling unit design.

SUMMARY OF THE INVENTION

The general purpose of the present invention, which will be described subsequently in greater detail, is to provide an economical, energy efficient, simple coil and filter that will be easily applied into the spatial constraints of existing commercial air handling systems.

It has many of the advantages mentioned heretofore and many novel features that result in new, high efficiency conditioning air components which are not anticipated, rendered obvious, suggested, or even implied by any of the prior art, either alone or in any combination thereof.

In accordance with the invention, an object of the present invention is to provide an improved air filter and heat exchanger coil that will reduce air friction compared to a conventional design.

It is another object of this invention to provide improved an air filter and cooling/heating coil that increases heat transfer and particulate filtration while reducing air resistance.

It is a further object of this invention to provide an improved air filter and cooling/heating coil that is simple and economical to construct.

It is a final object of the present invention to provide and improved air filter and heat exchanger coil design that will reduce the height and resultant casing cost of air handling units.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements. Other objects, features and aspects of the present invention are discussed in greater detail below.

DETAILED DESCRIPTION

Figure 1:
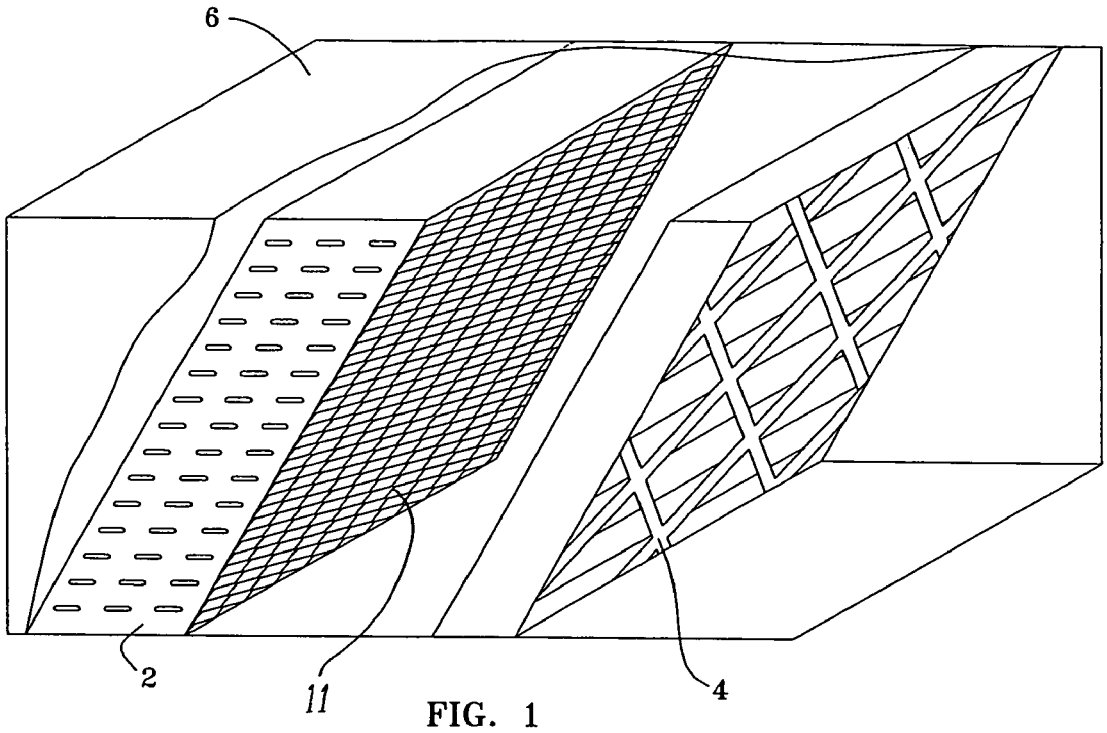
FIG. 1 is a perspective view of the slant air conditioning coil and slant filter arrangement installed in an air handling enclosure.

The present invention relates to a high efficiency coil and filer for an air handling system, utilizing a slant design that can be easily applied to new air handling systems and capable of offering significant increases in efficiency.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings.

The invention is capable of other embodiments and of being practiced and carried out in various ways. Also, it is to be understood that the phraseology and terminology employed herein are for the purpose of descriptions and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

The components and operation of a standard cooling/heating coil and filter as used in an air conditioning system are well known in the industry. It is the unique geometric configuration and design of these that are the subject of this invention.

Figure 4:
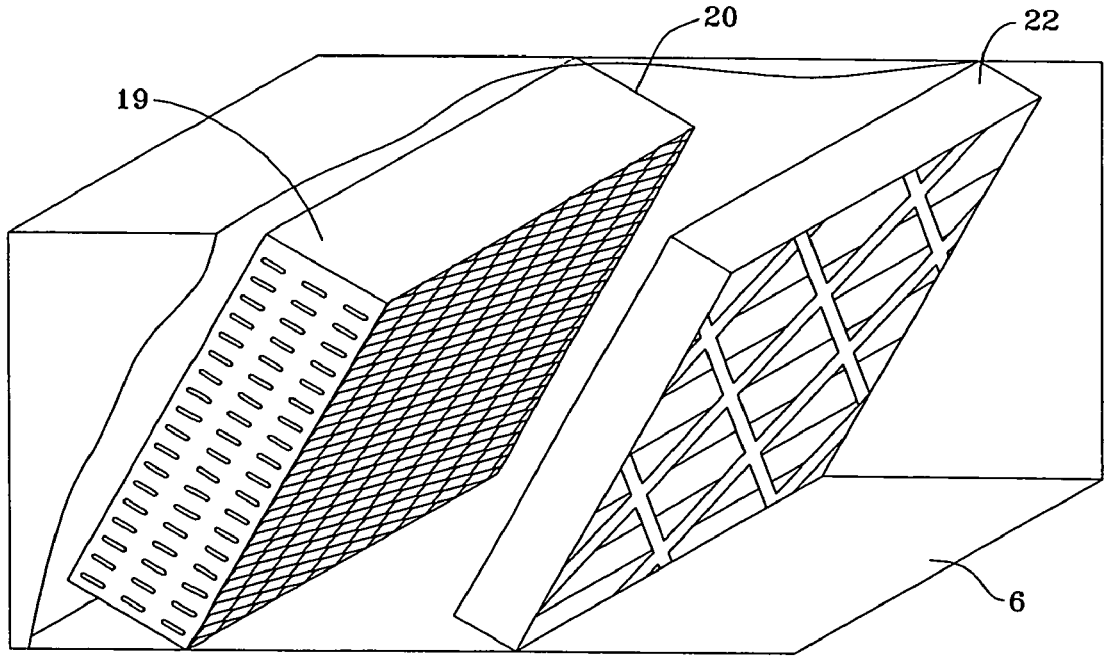
FIG. 4 is a perspective view of an angled conventional air conditioning coil and filter arrangement installed in an air handling enclosure.
Figure 2:
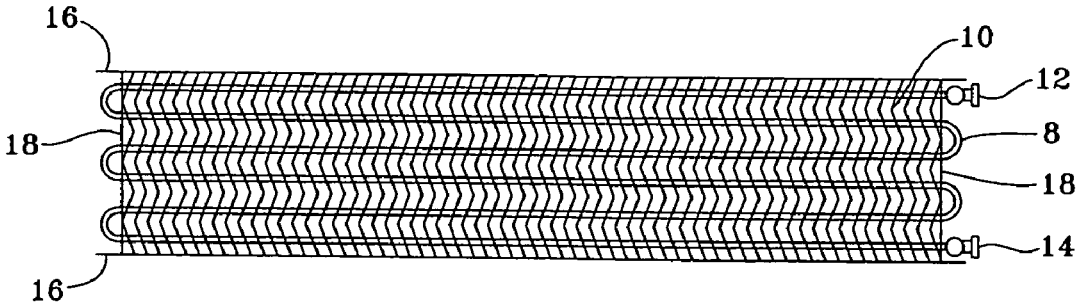
FIG. 2 is a top cross sectional view of a conventional air conditioning coil.

Looking at FIG. 1, the slant air conditioning coil 2 and slant filter 4 arrangement can be seen installed in an air handling unit 6. Referring to FIG. 2 the general arrangement of an air conditioning coil can be seen. Other than the geometric configuration differences between a conventional coil 20 and a slant coil 2, both coils have the same elements. The coils are of a generally planar shape that have rows of substantially similar bent tubes 8 held in a substantially equally spaced, parallel arrangement from adjacent tubes by a plethora of congruent, thin pleated (or flat) fins 10, through which the tubes 8, pass normally. All tubes are connected at one end to an inlet header 12 and at the other, distal end, to an outlet header 14. The fins 10 reside substantially parallel to adjacent fins 10. Fins 10 are shown in a pleated configuration, although they may be in a truly flat planar configuration as well. The tubes 8, fins 10, inlet header 12 and outlet header 14 are held in their spatial arrangement by support frames 16, side support plates 18 and top/bottom support plates 19 (FIG. 4). These support frames 16, side support plates 18 and top/bottom support plates 19 form a support structure. For clarification purposes throughout, all coils are illustrated from the side that does not have the inlet header 12 and outlet header 14 affixed thereon.

It is well known in the industry that support structures vary, however the conventional overall geometric shape of a coil is cuboid. The overall geometric shapes of the slant coil 2 and slant filter 4 are parallelepiped as seen in FIG. 1, for example, or more particularly are that of oblique prisms having three pair of congruent (and thus parallel) sides, two pair of which form rectangles and one pair which forms a non-rectangular parallelogram. This is best illustrated in FIG. 1. (Stated otherwise, the coil and filter have axial cross sections in the geometric shape of a parallelogram possessing both acute and obtuse interior angles.)

The slant filter 4 and conventional filter 22 are illustrated as generic pleated filter designs. The actual filter media can be selected from a plethora of available air filtration media including but not limited to fiberglass and pleated cotton.

Figure 3:
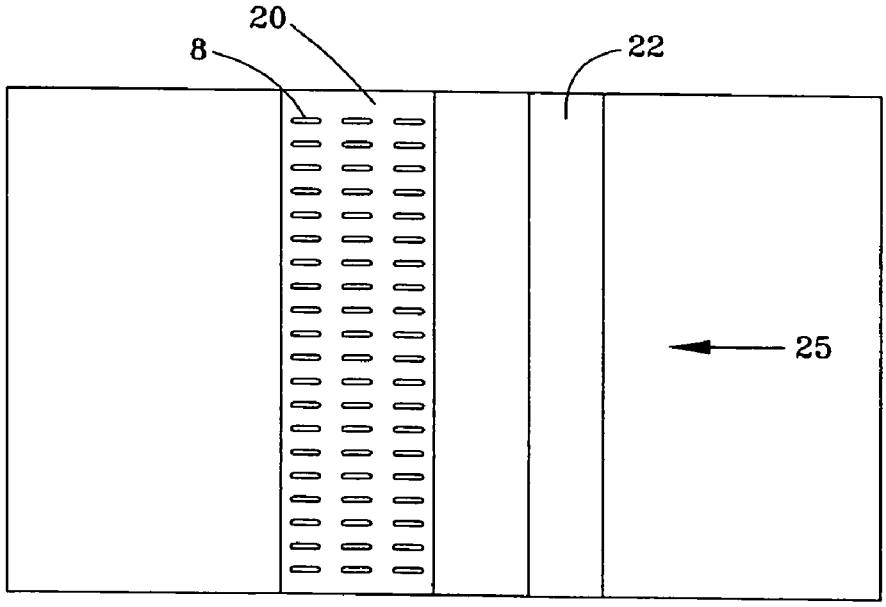
FIG. 3 is a side view of a conventional air conditioning coil and filter arrangement installed in an air handling enclosure.

Looking at FIG. 3, the conventional industry standard for placement of conventional air conditioning coils 20 and conventional filers 22 is illustrated. It can be seen that both conventional coil 20 and conventional filter 22 have a cuboid geometry. Generally, conventional coil 20 and conventional filter 22 reside perpendicular to the direction of air flow 25. In this manner, the plane of each tube 8 is parallel to the direction of air flow 24.

When additional cooling is required larger conventional coils 20 and larger conventional filters 22 are placed on an angle into the air handling unit 6. This is illustrated in perspective in FIG. 4 and in side view in FIG. 5. While this angling does offer an increased surface area, it is less efficient as will be evident when discussed later, herein. This angled placement results in voids 24 that can be seen between the top/bottom support plates 19 and the air handling unit 6. A similar situation exists about the conventional filter 22 and air handling unit 6 wherein voids 24 are also created.

Figure 6:
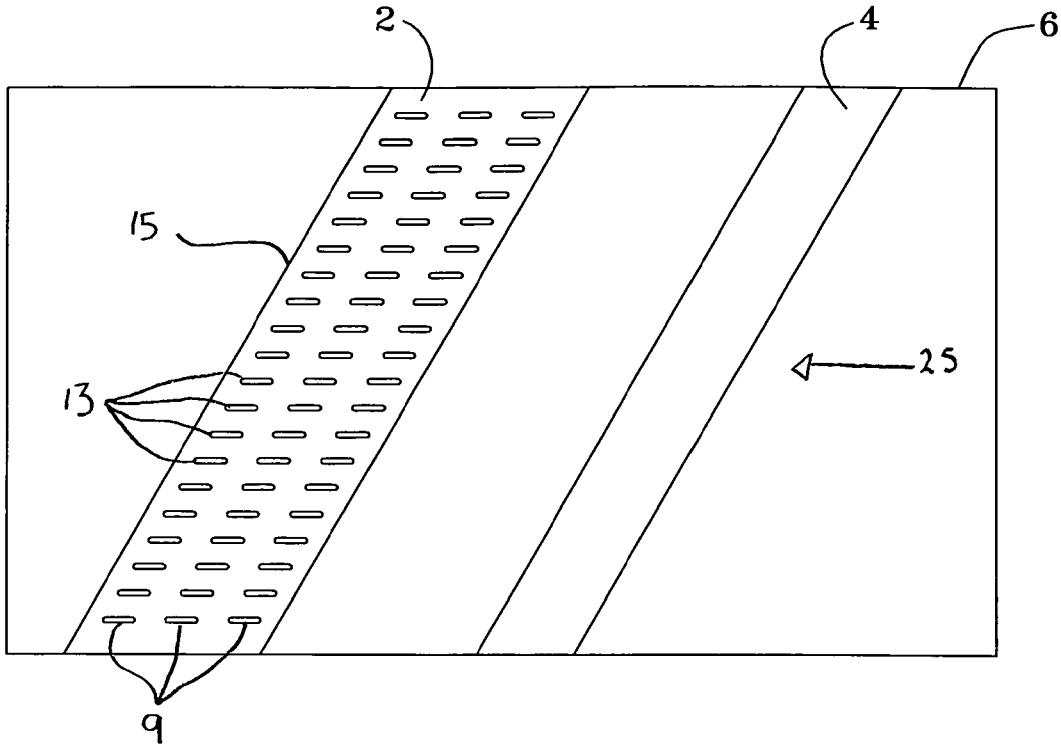
FIG. 6 is a side view of a slant air conditioning coil and slant filter arrangement installed in an air handling enclosure.

Looking at the slant coil 2 and slant filter 4 in FIG. 6, it can be seen that both of their cross sections form parallelograms rather than rectangles. In this manner there are no voids and less air turbulence. The importance of this is that coil 2 has more face area 11 which decreases the face velocity and air resistance, and fins 10 have more surface area with which to transfer heat, increasing efficiency.

Figure 7:
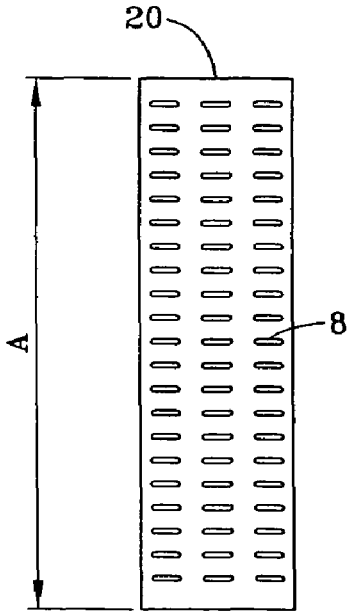
FIG. 7 is a side view of a conventional air conditioning coil.
Figure 8:
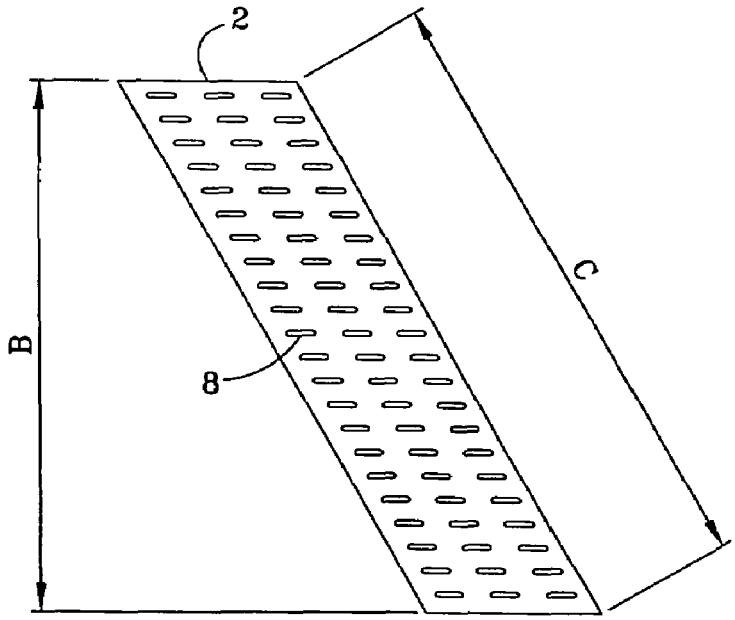
FIG. 8 is a side view of a slant air conditioning coil.

FIGS. 7 and 8 show side by side comparisons of a slant coil 2 and a conventional coil 20. It can be seen that the air handling unit height of the conventional coil 20 (denoted as line A in FIG. 7) is the same as the effective face height for this coil. In the slant coil 2 the effective face height (denoted as line C in FIG. 8) is greater than the air handling unit height (denoted as line B in FIG. 8) by the air handling unit height/cosine of the angle of inclination. The inclination of the slant coil 2 in the air handling unit 6, changes the face area 11 of the coil 2 as depicted in the following chart.

Coil Angle vs Change in Coil Face Area

| Angle of Coil (from air flow direction) | Coil Face Area (linear units$^2$) | Increase from Conventional |
|---|---|---|
| 90 | 100 | N/A |
| 60 | 121 | 21% |
| 45 | 141 | 41% |
| 30 | 200 | 100% |

Figure 5:
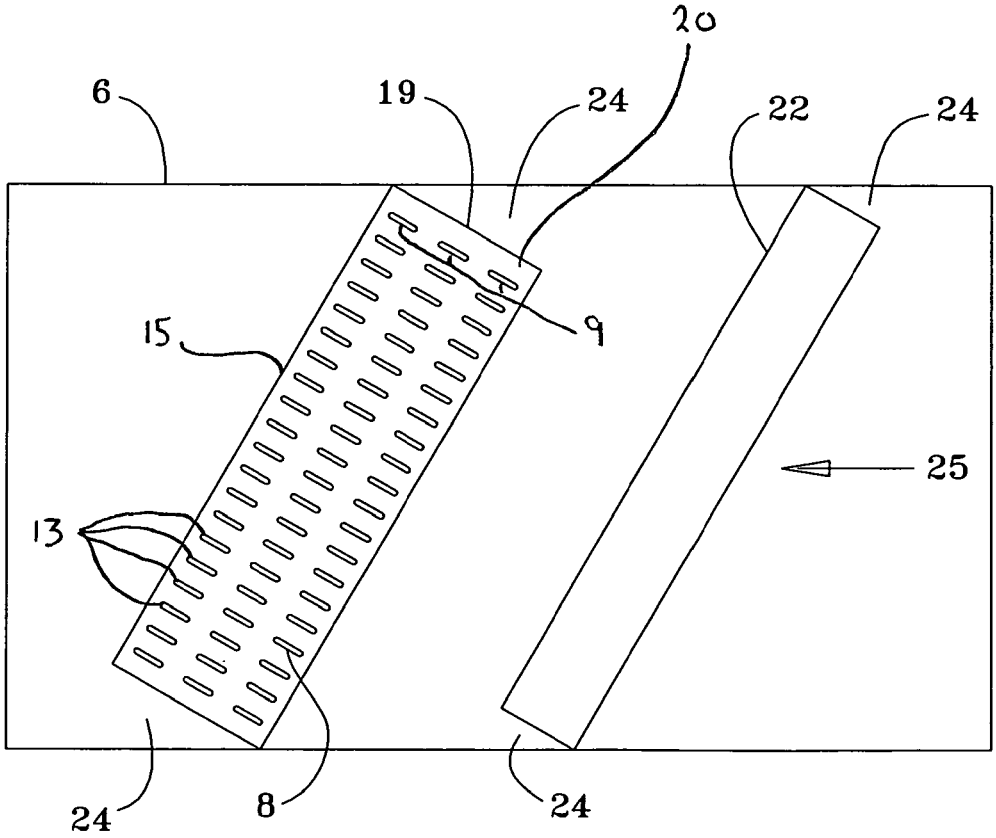
FIG. 5 is a side view of an angled conventional embodiment air conditioning coil and filter arrangement installed in an air handling enclosure.

Looking at FIGS. 5 and 6 the differences between the configuration of the tubes 8 between the conventional coil 20 and the slat coil 2 can best be seen. The tubes 8 in both coils lie in substantially similar, parallel tube columns 13 with identical spacing between the tubes 8 in each column 13. In FIGS. 5 and 6 each coil only has three tube columns 13 that are oriented vertically, but it is well known in the art that the position and number of tube columns is adjusted to fit the specific requirements of the situation. The tube columns are arranged such that the tubes in adjacent tube columns 13 form tube rows 9 that each reside in a common plane.

In the conventional coil 20 the plane of tube rows 9 lies normal to the plane of the tube columns 13 and the coil face 15. In the slant coil 2 the plane of tube rows 9 resides at an angle to the plane of the tube columns 13 and the coil face 15. This angle in the slant coil is the same angle as that formed between the top/bottom support plates 19 and the side support plates 18, which is also the same angle formed between the coil face 15 and the air handling unit. In this way, when the slant coil 2 resides in the air handling unit 6 the plane of the tube rows resides parallel to the flow of air in the air handling unit 6. By ensuring that these planes of tube rows reside parallel to both the linear axis of the flow handling unit 6 and the flow of air in the air handling unit 25, turbulence, friction and back pressure are minimized as discussed in detail herein.

In contrast, when the conventional coil 20 is placed in the air handling unit 6 so as to reside at an angle, the plane of the tube rows resides at an angle with respect to the flow of air in the air handling unit 6, decreasing efficiency and increasing friction, turbulence and back pressure.

Figure 10:
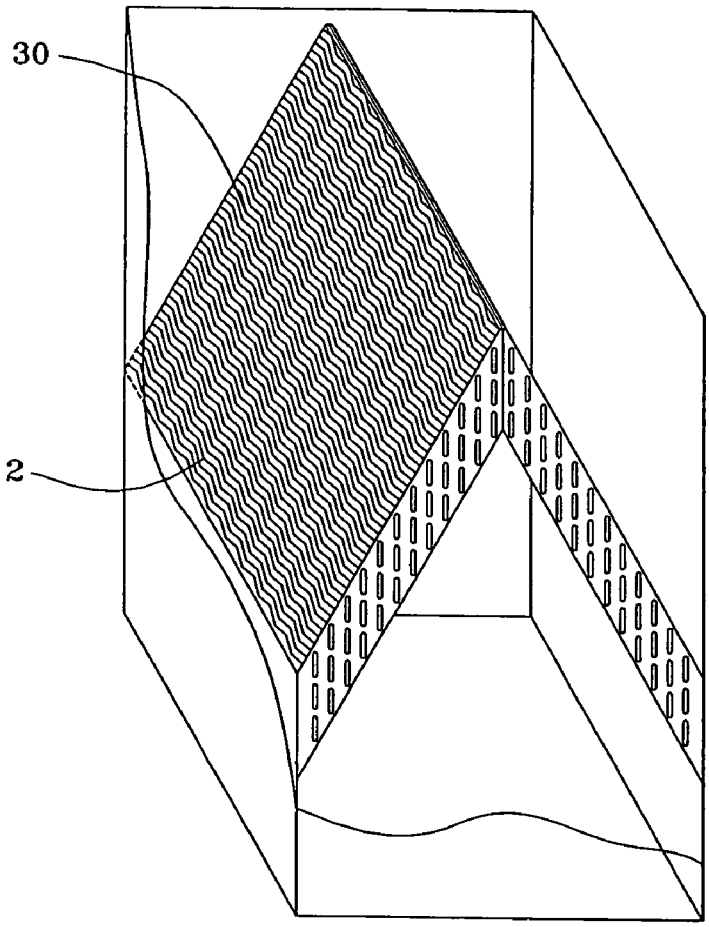
FIG. 10 is a perspective view of a slant "A Coil" installed in an air handling enclosure.
Figure 9:
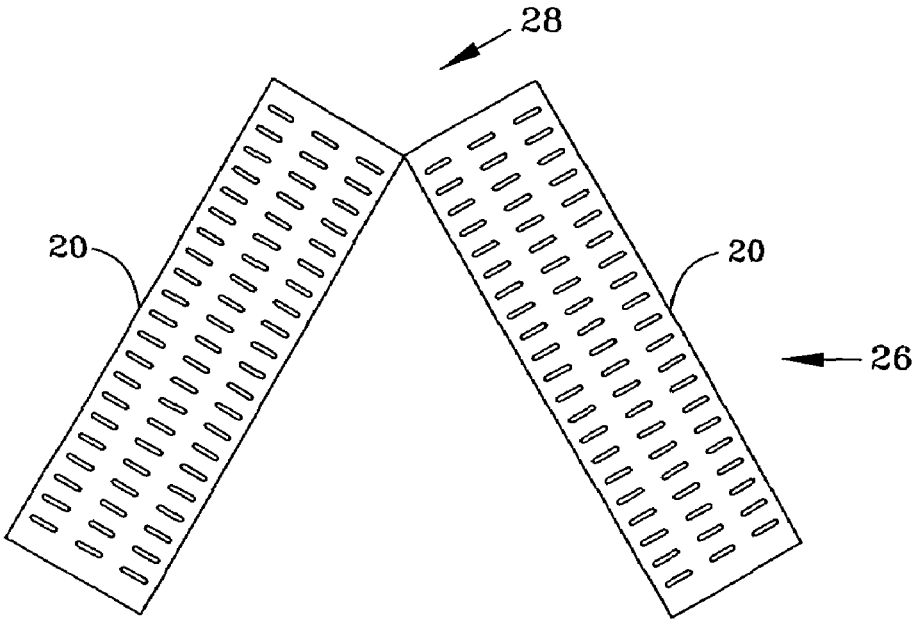
FIG. 9 is a side view of two angled conventional air conditioning coils coupled to form an "A Coil"

FIG. 9 depicts the normal configuration of an "A coil" 26. The industry standard is to angle two conventional coils 20 toward each other to form a coil in the shape of the letter A. This formation results in under utilized space 28. Using a combination of two slant coils 2 to form a slant A coil 30, (FIG. 10) the advantages of increased heat transfer surface, lower air resistance, and reduced air turbulence, results in a higher overall efficiency.

Figure 11:
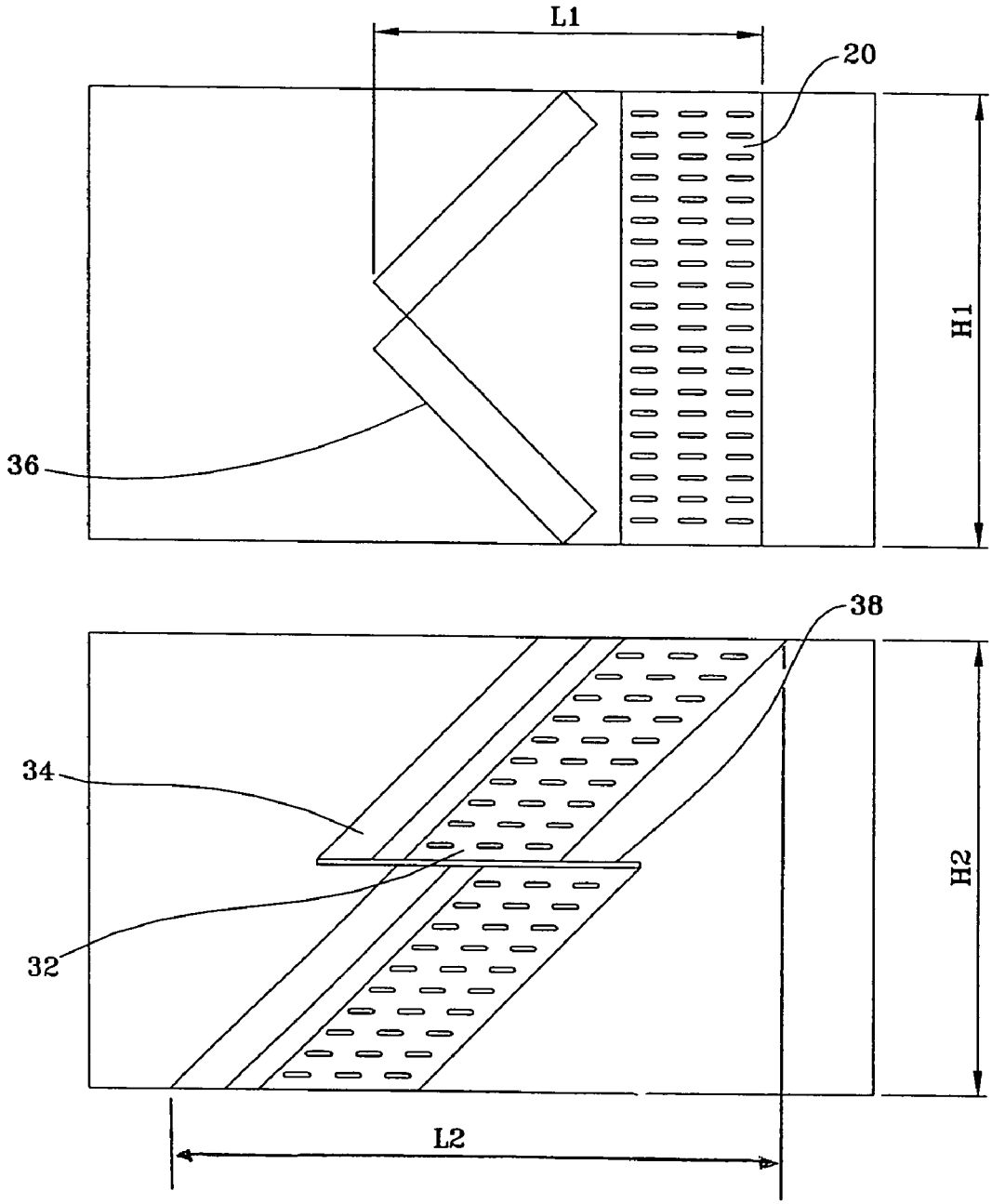
FIG. 11 is comparative view of the linear spatial arrangement of a conventional air conditioning coil and a staggered slant coil and slant filter arrangement.

FIG. 11 shows a comparison between a staggered slant coil 32 and staggered slant filter 34 combination, and that of a conventional coil 20 and a Vee filter 36 arrangement. The air handling unit length used to house this staggered slant combination is shorter than that required to house a slant coil 2 and slant filter 4 and rivals that of the abovementioned conventional arrangement. Basically, two shortened, slant coils are offset into a vertically staggered configuration and held in this configuration by a common support member 38. It can be seen that the air handling unit length L2 of the staggered configuration approaches the air handling unit length L1 of a conventional coil 20 and filter. The benefit of the staggered slat coil 32 design is that it provides more coil face area 11 than a conventional coil 20 yet utilizes the same height and similar length requirements as does a conventional coil 20 in an air handling unit. The same can be said about the staggered slant filter 34 design.

The advantages of the present invention in operation, are best explained in the following section. To achieve an increase in heat transfer efficiency and particulate filtration effectiveness and holding capacity, the passing air must encounter more coil (more fin surface area, more coil face area 11 and number of tubes 8) and more filter media surface area. If the media and coil reside normal to the passing air, then the resistance to air flow must rise since there is more coil and filter media to traverse through or across, than initially. This will necessitate larger, energy consuming air drivers (fans). Any gains in heat transfer and filtration must then be offset against the heat input of the larger fans and additional energy losses. However, this can be accomplished with the angled units or slant design while also lowering the coil face velocity and air resistance.

In transferring heat with a coil, the heat transfer area of the coil must remain in contact with the passing air for as long as possible and the fins that transfer the heat by virtue of their surface area size must be maximized. The efficiency of the filtration is a function of the amount of filter media that the air passes through. Angling these elements at 45 degrees offers a 41% increase in face area. The effective face area of a slant coil 2 and or slant filter 4 can be adjusted by selecting a greater angle that they sit in the air handling unit 6. As the angle is decreased below that of the 90 degree, vertical position that their conventional counterparts reside in, their efficiency rises. Unfortunately, as the angle is reduced as above, the amount of length in the direction of air flow that the slant coil 2 and slant filter 4 occupy also rises. Thus, the slant angle used on the invention described herein may be dictated by either the efficiency desired or the air handling unit's spatial constraints.

Experimentation was performed with a first conventional coil placed at 90 degrees in an air handling unit, a second conventional coil placed at 45 degrees in the same air handling unit and a slant coil placed at 45 degrees in the same air handling unit. The face areas of the first conventional coil, second conventional coil and slant coil were respectively 10.42 $ft^2$, 12.08 $ft^2$ and 14.17 $ft^2$. The coils ran chilled water at a standard fluid flow rate of 31.30 gpm at an entering fluid temperature of 44.00 degrees Fahrenheit. The air flow was 5000 cfm. Their respective face velocities were 480 $ft^3$/min, 414 $ft^3$/min and 353 $ft^3$/min. The percentage decrease in air pressure drop for the second conventional coil and slant coil (with respect to the air pressure drop of the first conventional coil), were 24.3 percent and 42.8 percent. This results in a substantial savings in fan energy.

Experimentation has shown that with all parameters held substantially similar, a slant filter positioned at 45 degrees in an air handling unit vs a conventional filter positioned vertically (at 90 degrees), will result in 15 percent lowering of the fan static pressure giving a 27.7 percent savings in fan energy.

The above description will enable any person skilled in the art to make and use this invention. It also sets forth the best modes for carrying out this invention. There are numerous variations and modifications thereof that will also remain readily apparent to others skilled in the art, now that the general principles of the present invention have been disclosed.

Having thus described the invention, what is claimed as new and desired to be secured by Letters Patent is as follows:

1. An improved heat transfer means for conditioning air comprising:

a support structure having the geometry of an oblique prism, sized to frictionally fit about an interior perimeter of an air handling enclosure;

an air handling enclosure adapted to direct the flow of air and house said support structure;

a plurality of tubes configured into tube rows and tube columns so as to form a parallelepiped configuration;

at least one fin having a parallelogram surface configuration;

an inlet header; and an outlet header; wherein said support structure structurally positions and constrains said fin, said tube rows, said tube columns and said headers into a generally oblique prismatic configuration that resides at an angle relative to a flow of said air within said air handling enclosure wherein said fins are retained in a parallel spatial configuration with adjacent fins, and said tube rows are retained in a parallel spatial configuration with adjacent tube rows so as to have a plane oriented parallel to said flow of air when said support structure resides at said angle within said air handling enclosure, and wherein said tubes have an inlet end connected to said inlet header and an outlet end connected to said outlet header and said tubes pass normally through, and are in physical contact with said fins.

2. The improved heat transfer means for conditioning air of claim 1 wherein said fins are substantially identical and are of a pleated configuration.

3. The improved heat transfer means for conditioning air of claim 1 wherein said fins are substantially identical and are of a generally planar configuration.

4. The improved heat transfer means for conditioning air of claim 1 further comprising a generally planar air filter having a filter media constrained within the interior of a retaining enclosure wherein said enclosure has an axial cross section in the geometric shape of a non-rectangular parallelogram.

5. The improved heat transfer means for conditioning air of claim 4 wherein said filter media is pleated.

6. The improved heat transfer means for conditioning air of claim 2 further comprising an air filter having an oblique prismatic geometrical configuration.

7. The improved heat transfer means for conditioning air of claim 6 wherein said filter media is pleated.

8. The improved heat transfer means for conditioning air of claim 3 further comprising a generally planar air filter having an axial cross section in the geometric configuration of a parallelogram, having a filter media constrained within the interior of a retaining enclosure.

9. The improved heat transfer means for conditioning air of claim 3 wherein said filter media is pleated.

10. An improved heat exchanger system for conditioning air comprising:

an air handling duct for housing other components of said heat exchanger system and for directing the flow of said air along a longitudinal axis of said duct;

an oblique prismatic frame affixed within said duct at an angle relative to said longitudinal axis of said duct;

at least two planar columns of tubes and at least two planar rows of tubes adapted for the interior flow of a heat transfer fluid; and at least two congruent, thin, generally planar fins in a non-rectangular parallelogram pattern adapted for radiant heat transfer;

wherein said frame positions and retains said fins and said at least two planar rows of tubes and two planar columns of tubes into a generally oblique prismatic form, wherein said fins are arranged in a parallel spatial configuration with respect to adjacent fins, and said row of tubes reside parallel to adjacent rows of tubes such that said plane of said rows of tube resides parallel to said longitudinal axis of said duct and said tubes pass normally through each of said fins in said fins' parallel spatial arrangement.

11. The improved heat exchanger system for conditioning air of claim 10 wherein said non-rectangular parallelogram pattern of said fins contains an interior acute angle between 30 and 90 degrees.

12. The improved heat exchanger system for conditioning air of claim 10 wherein said heat exchanger also comprises:

an inlet header adapted to provide an inlet of flowing heat transfer fluid into at least one said planar row of tubes; and an outlet header adapted to receive an outlet of flowing heat transfer fluid from at least one said planar row of tubes.

13. The improved heat exchanger system for conditioning air of claim 11 further comprising a generally planar air filter having a non-rectangular, parallelogram axial cross section, having a filter media constrained within the interior of a retaining enclosure.

14. The improved heat exchanger system for conditioning air of claim 13 wherein said filter media is pleated.

15. The improved heat exchanger system for conditioning air of claim 13 further comprising a generally planar air filter having a parallogram axial cross section, having a filter media constrained within the interior of an oblique prismatic retaining enclosure.

16. The improved heat exchanger system for conditioning air of claim 15 wherein said filter media is pleated.

17. The improved heat exchanger system for conditioning air of claim 12 further comprising a generally planar air filter having a filter media constrained within the interior of an oblique prismatic configured retaining enclosure.

18. The improved heat exchanger system for conditioning air of claim 17 wherein said filter media is pleated.

19. A heat exchanger system for conditioning air comprising:

an air handling duct constraining and directing a flow of air along a longitudinal axis of said duct;

a support structure having the geometry of an oblique prism;

at least two planar rows of tubes;

at least two congruent fins having longitudinal cross sections of a parallelogram;

an inlet header;

an outlet header, a filter casing having the geometric configuration of an oblique prism; and a filter media, wherein said support structure structural positions and constrains said fins, said rows of tubes and said headers into a generally oblique prismatic geometrical configuration within said duct at an angle relative to the longitudinal axis of said duct, wherein said fins are retained in a parallel spatial configuration to adjacent fins, and said row of tubes are retained in a parallel spatial configuration to adjacent rows of tubes such that said planes of said rows of tubes reside parallel to said longitudinal axis of said duct and have an inlet end connected to said inlet header and an outlet end connected to said outlet header and said tubes pass normally through, and are in physical contact with said fins; and wherein said filter media is constrained within said oblique prism geometry of said filter casing.

* * * * *